US005329064A

United States Patent [19]

Tash et al.

[11] Patent Number: 5,329,064

[45] Date of Patent: Jul. 12, 1994

[54] SUPERIOR SHIELD CABLE

[75] Inventors: Thomas G. Tash; William A. King, both of Richmond, Ind.

[73] Assignee: Belden Wire & Cable Company, Richmond, Ind.

[21] Appl. No.: 955,517

[22] Filed: Oct. 2, 1992

[51] Int. Cl.[5] ..... H01B 7/34

[52] U.S. Cl. ..... 174/36; 174/106 R; 174/109

[58] Field of Search ..... 174/36, 105 R, 106 R, 174/109

[56] References Cited

U.S. PATENT DOCUMENTS 3,032,604 5/1962 Timmons ..... 174/115
3,484,532 12/1969 Anderson ..... 174/36
4,323,721 4/1982 Kincaid et al. ..... 174/36
4,327,246 4/1982 Kincaid ..... 174/36
4,477,693 10/1984 Krabec et al. ..... 174/36
4,691,081 9/1987 Gupta et al. ..... 174/105 R
4,701,575 10/1987 Gupta et al. ..... 174/107

*Primary Examiner*—Morris H. Nimmo
*Attorney, Agent, or Firm*—Laff, Whitesel, Conte & Saret

[57] ABSTRACT

A braided cable having outwardly successive layers including: a core having a transmission medium, the transmission medium being an insulated conductor; a shielding tape surrounding the core and extending longitudinally within and parallel to the length of the cable, the shielding tape having a first edge and an oppositely located second edge, the first and second edge overlapping by inwardly curving towards one another, the shielding tape further having at least one layer of aluminum material and a second layer of polyolefin or polyester material; a cable braid longitudinally surrounding the shielding tape; and an outer jacket longitudinally surrounding the cable braid.

10 Claims, 1 Drawing Sheet

SUPERIOR SHIELD CABLE

FIELD OF THE INVENTION

This invention relates to cables. More particularly, this invention relates to a braided cable with increased shield effectiveness.

BACKGROUND OF THE INVENTION

A variety of shielded cables are known. These known shielded cables typically utilize a helically applied foil shield (see, for example, U.S. Pat. Nos. 4,323,721 and 4,327,246). In addition to the aforementioned helically applied foil shield cables, there are other shielded cables which include the following configurations: one, a laterally applied foil shield under a cable braid; two, a Z-Fold TM foil under a cable jacket; or three, a cable braid under a cable jacket. While these known cables provide fairly adequate shield protection at low, middle or high frequencies, there is no cable that utilizes all three configurations (a laterally applied foil shield, a Z-Fold foil, and a cable braid) simultaneously to provide superior or increased shield effectiveness.

SUMMARY OF THE INVENTION

Accordingly, it is an object of the present invention to provide a braided cable having increased shield effectiveness.

It is another object of the present invention to provide a braided cable that may be used in applications where high frequency electron signal emissions must be minimized.

It is yet another object of the present invention to provide a braided cable that has a variety of applications, including data transmission and industrial applications.

The objectives and advantages of the present invention are achieved, in a preferred embodiment, by providing a cable with one or more insulated conductors that are covered and surrounded by outwardly successive layers of a shielding tape with a Z-Fold, a cable braid, and an outer jacket.

The shielding tape is laterally applied beneath the cable braid and over the conductors. The z-fold configuration of the shielding tape improves voltage breakdown characteristics of the cable. A heat sensitive adhesive is located beneath the shielding tape.

The combination of the above layers of the cable (the shielding layer with Z-Fold, the braid and the outer jacket) in conjunction with the lateral wrap application of the shielding tape provide a superior shielded cable which improves voltage breakdown characteristics and provides overall superior shielding characteristics. Furthermore, this specific cable design prevents the emission of electronic signals of the type usually detected by "bugging" devices. Moreover, the cable may be used in numerous applications, including data transmission applications (where shielding prevents signal loss) and industrial applications (where shielding blocks radiated interference).

DETAILED DESCRIPTION OF INVENTION

Figure 1:
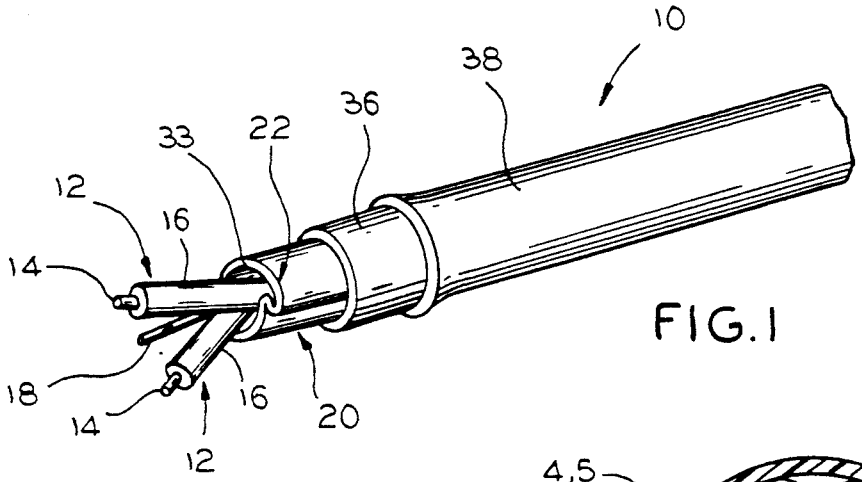
FIG. 1 is a perspective view of the inventive cable.
Figure 2:
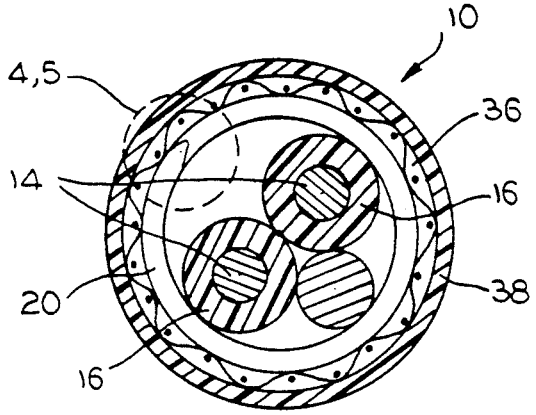
FIG. 2 is a cross-sectional view of the cable of FIG. 1.

Referring to FIGS. 1 and 2, the present invention, in a preferred embodiment, provides a cable, generally denoted by the numeral 10, for use in transmission and industrial applications. Cable 10 includes one or more conductors 12 each of which include solid or stranded wires 14 which are covered with an insulating material 16, such as rubber, plastic and the like. In the preferred embodiment, cable 10 includes dual conductors. However, any configuration of conductors may be utilized. If there is more than one conductor, the conductors are typically helically twisted around one another. A drain wire 18 is located longitudinally within cable 10 and parallel to the conductors and provides a means to terminate the shield of the cable.

Figure 3:
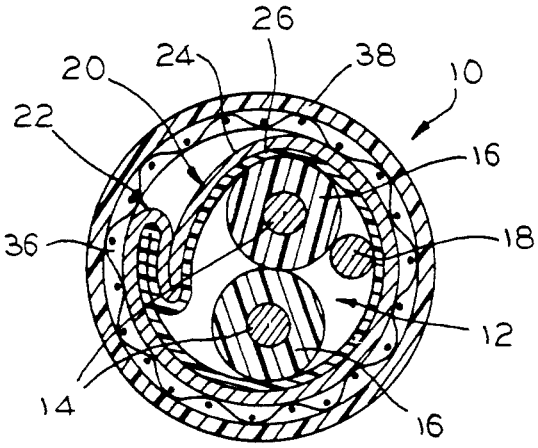
FIG. 3 shows an alternate embodiment of the cable of FIG. 1.
Figure 4:
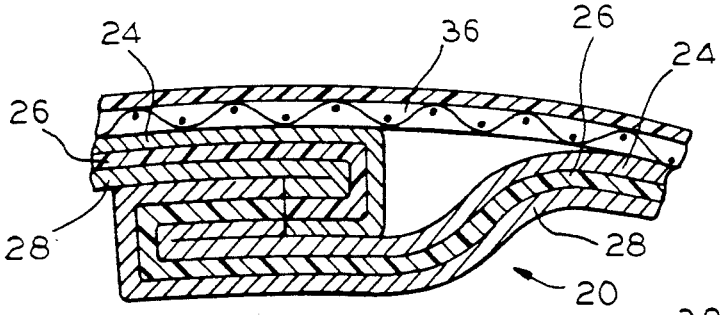
FIG. 4 is a cross-sectional view of the cable of FIG. 1 taken along line 4 showing a Z fold.
Figure 5:
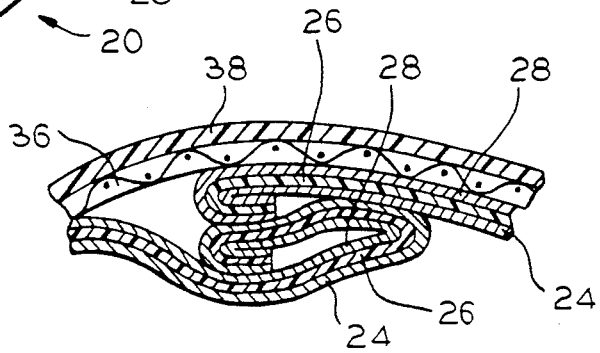
FIG. 5 is a cross-sectional view of the cable of FIG. 1 taken along line 5 showing another Z fold.

Surrounding the conductors and extending in parallel relation to the cable length is a laterally applied shielding tape 30 with a Z-Fold 22, which is discussed in greater detail hereinafter. The shielding tape preferably includes three outwardly successive layers of aluminum 24, polyolefin (polyethylene and/or polypropylene) or polyester (Mylar) 26, and aluminum 28. Thus, in the preferred embodiment, the shielding tape includes layers of aluminum which are bonded to opposite sides of the polyethylene or polyester layer (see FIG. 3). Alternatively, however, the shielding tape may include only two bonded layers—an outer aluminum layer and an inner polyethylene or polyester layer (see FIG. 3). However, in either of the above embodiments, a heat sensitive adhesive 30 is included on the surface of the shielding tape which is in closest proximity to the conductor(s).

In the preferred embodiment, the first and third aluminum layers 24, 28, respectively, of the shielding tape are from about 0.00030 to 0.00040 inches in thickness but are preferably each 0.00035 inches thick. Likewise, the second layer of polyethylene or polyester 26 is from about 0.00088 to 0.00097 inches in thickness but is preferably 0.00092 inches thick. The overall thickness of the shielding tape is preferably approximately 0.00127 and 0.0016 inches thick.

Shielding tape 20 includes a first edge 27 and a second edge 29 that are located on opposite ends of the tape. Edge 27 and edge 29 overlap with one another to form the Z-Fold 22. The overlap of edges 27 and 29 actually occurs by inwardly curving each edge toward one another (see FIG. 2) so that the configuration of the shielding tape resembles the letter "Z".

The overlap of edges 27 and 29 forms a shorting fold 32 which is the fold formed by doubly overlapping the shielding tape to form the letter "Z". The shorting fold provides metal-to-metal contact on the shielding tape. Shorting fold 32 is held together by any suitable fastening means 33.

Shielding tape 20 also includes an isolation fold 34 which prevents adjacent shields from shorting one another.

Both shielding tape 20 and Z-Fold 22 extend longitudinally within and parallel to the length of cable 10. Likewise, shielding tape 20 and Z-Fold 22 are laterally applied beneath the cable braid and around the conductor(s). Overall, Z-Fold 22 of shielding tape 20 improves the high frequency performance of the cable.

Surrounding shielding tape 20 is a braid 36 which is preferably made of a copper or a tin-coated copper material. An outer jacket 38 then concentrically surrounds braid 36 and is made from any number of materials, including a polyvinyl chloride, a polyethylene or a tetrafluoroethylene polymer (Teflon) material.

Cable 10 has not been described in terms of approximate measurements, as it should be understood that the dimensions of the cable may vary according to need.

Therefore, it should be recognized that, while the invention has been described in relation to a preferred embodiment thereof, those skilled in the art may develop a wide variation of structural details without departing from the principles of the invention. Accordingly, the appended claims are to be construed to cover all equivalents falling within the true scope and spirit of the invention.

The invention claimed is:

1. A braided cable having outwardly successive layers comprising:

a core comprising a transmission medium, said transmission medium being an insulated conductor;

a shielding tape surrounding said core and extending concentrically within and parallel to the length of said cable, said shielding tape having a first edge and an oppositely located second edge, said first and second edge overlapping by inwardly curving towards one another, said shielding tape further comprising at least one layer of aluminum material and a second layer of polyolefin or polyester material;

a cable braid longitudinally surrounding said shielding tape; and an outer jacket longitudinally surrounding said cable braid.

2. The cable claim 1 wherein said conductor is metallic.

3. The cable of claim 1 wherein said shielding tape includes a third layer of aluminum material that covers the exposed side of the polyolefin or polyester material.

4. The cable of claim 1 wherein said shielding tape is laterally applied beneath said cable braid and around said core.

5. The cable of claim 1 further comprising a heat sensitive adhesive that is located along the inside of said shielding tape.

6. The cable of claim 1 wherein a fastening means attachably secures said overlapping and inwardly curved first and second edges.

7. The cable of claim 1 wherein said cable braid is a copper or a tin-coated copper material.

8. The cable of claim 1 wherein said outer jacket is made of material selected from the group consisting of polyvinyl chloride, polyethylene or tetrafluoroethylene polymer.

9. The cable of claim 3 wherein said overlapping and inwardly curved first and second edges form a shorting fold which provides metal-to-metal contact between the first and third layers of aluminum on said shielding tape.

10. A braided cable comprising:

a core which comprises a transmission medium, said transmission medium being an insulated metallic conductor;

a laterally applied shielding tape surrounding said core and extending longitudinally within and parallel to the length of said cable, said shielding tape having a first edge and an oppositely located second edge, said first and second edge overlapping by inwardly curving towards one another, said shielding tape comprising a first layers of aluminum material, a second or middle layer of polyolefin or polyester material, and a third layer of aluminum material, said first and third layer of aluminum material being bonded to opposite sides of said middle layer of polyolefin or polyester material, said overlapping and said inwardly curved first and second edges forming a shorting fold which provides metal-to-metal contact between said first and third layers of aluminum on said shielding tape, said shielding tape further comprising an isolation fold for preventing adjacent shields from shorting one another;

a cable braid which encloses and longitudinally surrounds said laterally applied shielding tape; and an outer jacket which longitudinally surrounds said braid.

* * * * *